US006435646B2

(12) United States Patent
Martin et al.

(10) Patent No.: US 6,435,646 B2
(45) **Date of Patent: *Aug. 20, 2002**

(54) FIBER TRACKING MANAGEMENT SYSTEM FOR INKJET PRINTHEADS

(75) Inventors: Warren S. Martin, Vancouver; Mark S. Engel, Camas, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 36 days.

This patent is subject to a terminal disclaimer.

(21) Appl. No.: 09/754,544

(22) Filed: Jan. 3, 2001

Related U.S. Application Data

(63) Continuation of application No. 09/303,800, filed on Apr. 30, 1999, now Pat. No. 6,220,691.

(51) Int. Cl.[7] ..... B41J 2/165
(52) U.S. Cl. ..... 347/22; 347/29; 347/33
(58) Field of Search ..... 347/22, 29, 32, 347/33

(56) References Cited

U.S. PATENT DOCUMENTS

| | | | | |
|---|---|---|---|---|
| 4,567,494 A | | 1/1986 | Taylor | 347/30 |
| 4,819,012 A | | 4/1989 | Kiyohara et al. | 347/30 |
| 5,745,133 A | | 4/1998 | Hendricks et al. | 347/33 |
| 5,774,140 A | * | 6/1998 | English | 347/33 |
| 5,949,448 A | | 9/1999 | Man et al. | 347/33 |
| 5,963,228 A | * | 10/1999 | Purwins | 347/31 |
| 5,980,018 A | | 11/1999 | Taylor et al. | 347/31 |
| 6,132,026 A | | 10/2000 | Taylor et al. | 347/32 |
| 6,220,691 B1 | * | 4/2001 | Martin et al. | 347/33 |

FOREIGN PATENT DOCUMENTS

| | | | |
|---|---|---|---|
| GB | 2319221 | | 11/1997 |
| JP | 62113554 | * | 5/1987 |

OTHER PUBLICATIONS

U.K. Patent Office, U.K. Search Report, Nov. 9, 2000, pp 1–3.

Commonly assigned, co–pending, U.S. application No. 08/667,611, filed Jul. 3, 1996, entitled "Integrated Translational Service Station for Inkjet Printheads". Pat No. 6,132,026 Oct. 17, 2000.

* cited by examiner

*Primary Examiner*—John Barlow
*Assistant Examiner*—Shih-Wen Hsieh

(57) ABSTRACT

A fiber tracking management system controls fibers clinging to an inkjet printhead in an inkjet printing mechanism, to stop these fibers from trailing across freshly printed wet ink and leaving unsightly fiber tracks. The system includes a sled which supports a fiber crushing member that contacts the printhead when the sled is in the servicing position and crushes fibers dangling from the printhead against the printhead. The printhead carriage has a datum which extends over the printzone and collects fibers from a wiper following printhead wiping. The system also has a fiber remover which removes fibers deposited along the exterior surface of the datum. The fiber remover may be a clutch actuator or other mechanism which plucks the fibers off the carriage, or a compressible pad which smashes the fibers and scrubs ink residue from the datum. A method of controlling fibers clinging to an inkjet printhead is also provided.

33 Claims, 5 Drawing Sheets

FIBER TRACKING MANAGEMENT SYSTEM FOR INKJET PRINTHEADS

CROSS REFERENCE TO RELATED APPLICATION

This is a continuation of application Ser. No. 09/303,800 filed on Apr. 30, 1999 now U.S. Pat. No. 6,220,691B1.

FIELD OF THE INVENTION

The present invention relates generally to inkjet printing mechanisms, and more particularly to a fiber tracking management system that uses a fiber-crushing pad around the capping assembly to prevent dust fibers and other debris from being dragged across freshly printed ink by the inkjet printheads, which avoids a print quality defect known as "fiber tracking."

BACKGROUND OF THE INVENTION

Inkjet printing mechanisms use cartridges (often called "pens") which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solid content than the earlier dye based inks, which results in a higher optical density for the new inks. Unfortunately, the combination of small nozzles and pigmented ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Two other earlier inkjet printing mechanisms using replaceable cartridges were the models 690C and 693C DeskJet® inkjet printers sold by the Hewlett-Packard Company of Palo Alto, Calif., the present assignee. This system used dye-based color inks and a pigment-based black ink, which had different servicing needs than the dye-based color inks. To maintain the desired ink drop size and trajectory, the area around the printhead nozzles must be kept reasonably clean. Wet ink and fibers of cotton, polyester, etc., often stick to the nozzle plate and the cheek areas adjacent the nozzle plate, particularly on a wide tri-color pen, causing print quality defects if not removed. This type of print quality defect is known as "fiber tracking," a problem which is more prevalent when printing with large volumes of black ink, which many consumers do when primarily printing text, indeed, many consumers use four or five black cartridges before replacing the full color cartridge.

Indeed, studies have shown that the type of fibers found inside a printer are typically made up of cotton and polyester fibers with a few animal hairs added, which are typically the same types of fibers that collect as dust balls in the corners of one's house. Wiping the nozzle plate only removes excess ink and other residue accumulated near the nozzle orifices, leaving the cheek regions unwiped to collect bits of dust, fabric fibers, animal hairs, and other debris.

Indeed, the DeskJet® 600 series of color inkjet printers produced by the Hewlett-Packard Company were particularly prone to fiber tracking print defects for several reasons. First, this series of printers uses the pigment-based black ink which was slow drying. Fibers that became attached to the print cartridges and the carriage hung down in the printzone to touch the paper, sometimes dragging into the black ink and creating fiber tracks. Fortunately, the dye based color inks did not have the same problem. Another reason this series of printers is prone to fiber tracking is that the wiper scraper cavities are located on the print cartridge, rather than in the service station. The wet ink and fibers that collect on the wiper are removed by contact with these wiper scraper cavities where the debris collects, according to design. This wiper scraper cavity design was favored because the inkjet cartridges used in these printers are disposable, so the collection of fiber debris was disposed of when the pen was replaced with a fresh cartridge. Moreover, in these printers the wiper does not wipe across the entire width of the pen, leaving portions of the front and back of the pen bottom which are not wiped and thus, free to collect fibers. Indeed, the 600 series of printers had carriage features which were at the same level as the pen, relative to the height of paper, and these surfaces came into direct contact with the wiper. Furthermore, the 600 series of inkjet printers requires more wiping to keep the pens healthy. More wiping means more wet ink which means the carriage becomes a welcome site for fiber collection soon after purchase, and fiber tracking service calls come in much sooner, as has been confirmed by monitoring calls to the manufacture's service center. Finally, after lengthy periods of inactivity, on the order of weeks or months, to begin in a print job the carriage first moves across the printzone to activate the media pick clutch, traveling over horizontal media support which has been collecting dust fibers during this period inactivity.

FIG. 7 shows how this fiber tracking problem occurred in a prior art inkjet printer. Here we see a color pen A and a black pen of B installed within an inkjet carriage C. The inkjet carriage C has pen alignment datums D which align the color pen B and the black A with respect to the printzone. The service station included a color wiper G and a black wiper H which respectively wiped a color printhead J of the color pen A, and a black printhead K of the black pen B. In this earlier wiping scheme, the wipers G and H removed fibers, debris and ink residue from the printheads J and K, but the wiper strokes stopped just past the edges of the printhead, leaving fibers F to collect on the four carriage datums D, as shown in a FIG. 7.

In one approach to addressing this fiber tracking problem, a translational wiping system using an orthogonal wiping stroke, was first sold by the Hewlett-Packard Company as the model 720C DeskJet® inkjet printer. To wipe the tri-color cartridge printhead, this system mounted a pair of auxiliary "cheek wipers" (also referred to by the designers as "mud flaps") to the wiper sled, adjacent a dual blade orifice plate wiper. There was no cheek wiping provided for the black printhead in this printer, which only used a dual-blade orifice plate wiper for the black pen. Thus, this system molded a total of six individual blades onto a stainless spring steel frame to form the wiper/mud flap assembly, two blades for the color orifice plate, two blades for the mud flaps, and two for the black orifice plate, all to service only two pens. The multitude of wiper blades made molding costly, not only in tooling costs, but all of these blades were difficult to remove as a unit from the mold, even using a one degree (1°) draft on the blades. Difficulty in removing the blades from the molds lead to a high scrap rate, and thus, an increased cost for the parts that were successfully made, which in turn, increased the overall cost of the printer.

SUMMARY OF THE INVENTION

According to one aspect of the present invention a fiber tracking management system is provided for controlling fibers clinging to an inkjet printhead installed in a carriage which traverses over a printzone to print an image on a print media with ink ejected from the printhead in an inkjet printing mechanism. The fiber tracking management system includes a sled which moves between a rest position and a servicing position. The fiber tracking management system also has a fiber crushing member supported by the sled to contact the printhead when the sled is in the servicing position and crush fibers dangling from the printhead against the printhead.

According to another aspect of the present invention, a fiber tracking management system is provided for controlling fibers clinging to an inkjet printhead installed in a carriage which traverses over a printzone to print an image on a print media with ink ejected from the printhead in an inkjet printing mechanism. The inkjet printhead has an orifice plate from which the ink is ejected and a cheek region adjacent the orifice plate. The fiber tracking management system includes a sled which moves between a rest position and a wiping position. A carriage has a feature located adjacent to the printhead which extends over the printzone, with this feature having an exterior surface. A wiper is supported by the sled where, through relative motion of the wiper and the printhead, the wiper wipes across the printhead orifice plate and across a first portion of the cheek region to remove ink residue and fibers therefrom when the sled is in the wiping position. The wiper then deposits the fibers removed from the printhead along the exterior surface of the carriage feature. The fiber tracking management system also has a fiber remover which removes fibers deposited along the exterior surface of the carriage feature.

According to an additional aspect of the present invention an inkjet printing mechanism is provided with the fiber tracking management systems described above.

According to another aspect of the present invention, a method is presented for controlling fibers clinging to an inkjet printhead installed in a carriage which traverses over a printzone to print an image on a print media with ink ejected from the printhead in an inkjet printing mechanism. This method includes the steps of moving the printhead into a servicing region of the inkjet printing mechanism, and thereafter, crushing fibers dangling from the printhead against the printhead with a fiber crushing member.

An overall goal of the present invention is to provide an inkjet printing mechanism which prints sharp vivid images, particularly when using slow drying pigment or dye based inks.

Another goal of the present invention is to provide a robust fiber tracking management system and method capable of minimizing fiber tracking print quality defects in an inkjet printing mechanism.

DETAILED DESCRIPTION OF THE PREFERRED EMBODIMENTS

Figure 1:
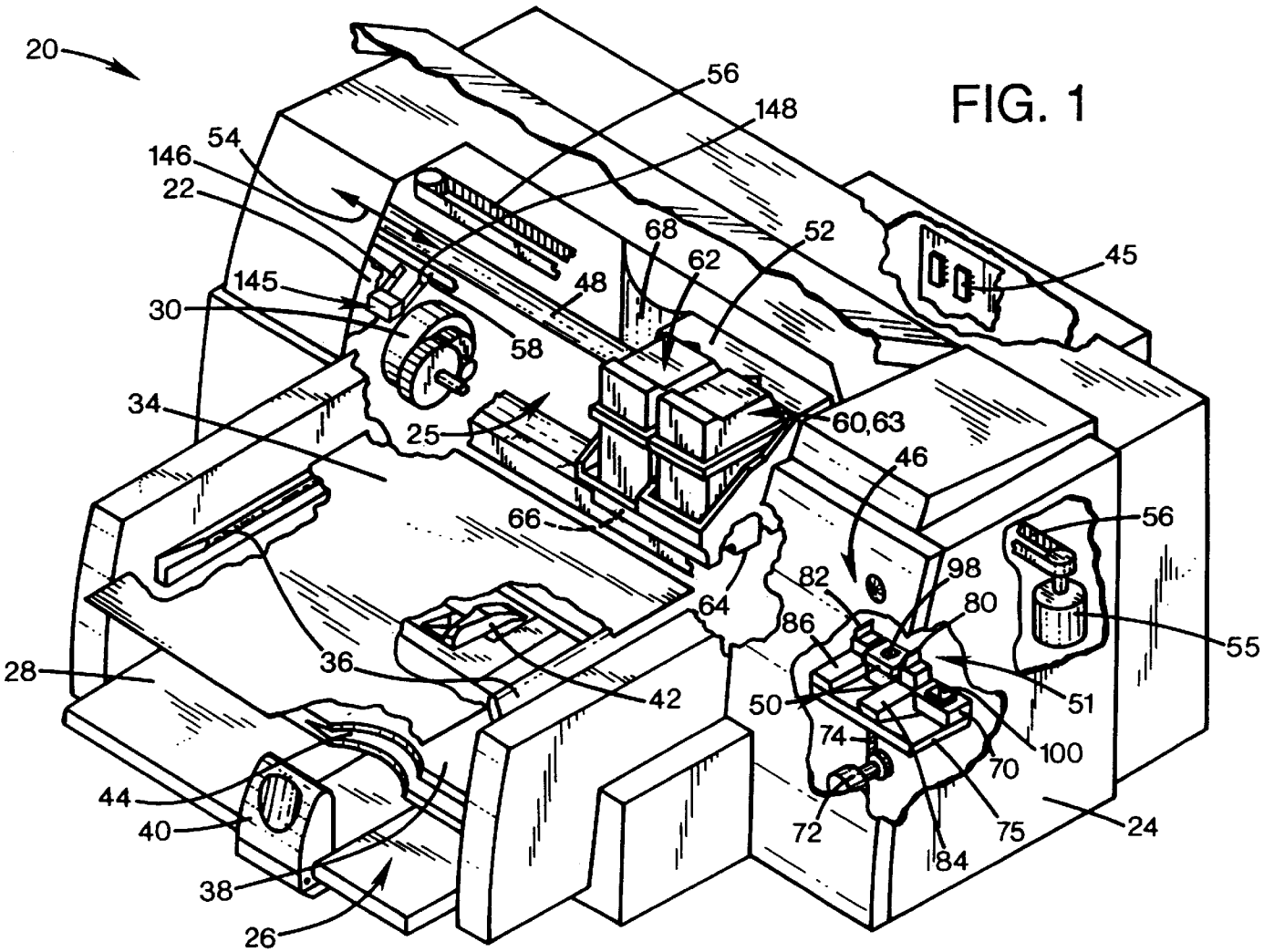
FIG. 1 is a fragmented, partially schematic, perspective view of one form of an inkjet printing mechanism having a fiber tracking management system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a media drive apparatus such as a stepper motor and drive gear assembly 30, may be used to move the print media from tray 28 into the printzone 25, as shown for sheet 34, for printing. After printing, the motor 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a envelope feed slot 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to extend over the printzone 25 and service station 50, located within a servicing region 51 inside the housing 24. The guide rod 48 slideably supports a dual inkjet pen carriage 52 for travel back and forth across the printzone 25 along a scanning axis 54. A carriage drive gear and DC motor assembly 55 is coupled to drive an endless belt 56. The motor 55 operates in response to control signals received from the controller 45. The belt 56 may be secured in a conventional manner to the carriage 52 to incrementally advance the carriage along guide rod 48 in response to rotation of motor 55.

To provide carriage positional feedback information to printer controller 45, an encoder strip 58 extends along the length of the printzone 25 and over the service station 50. A conventional optical encoder reader may also be mounted on the back surface of printhead carriage 52 to read positional information provided by the encoder strip 58. The manner of attaching the belt 56 to the carriage 52, as well as the manner providing positional feedback information via the encoder strip reader, may be accomplished in a variety of different ways known to those skilled in the art.

In the printzone 25, the media sheet 34 receives ink from an inkjet cartridge, such as a black ink cartridge 60 and/or a color ink cartridge 62. The cartridges 60 and 62 are also often called "pens" by those in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

The illustrated pens 60, 62 each include reservoirs for storing a supply of ink therein. The pens 60, 62 have printheads 64, 66 respectively, each of which have an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the printzone 25 under the nozzle. The printhead resistors are selectively energized in response to firing command control signals delivered by a multi-conductor strip 68 from the controller 45 to the printhead carriage 52.

Fiber Tracking Management System

Figure 2:
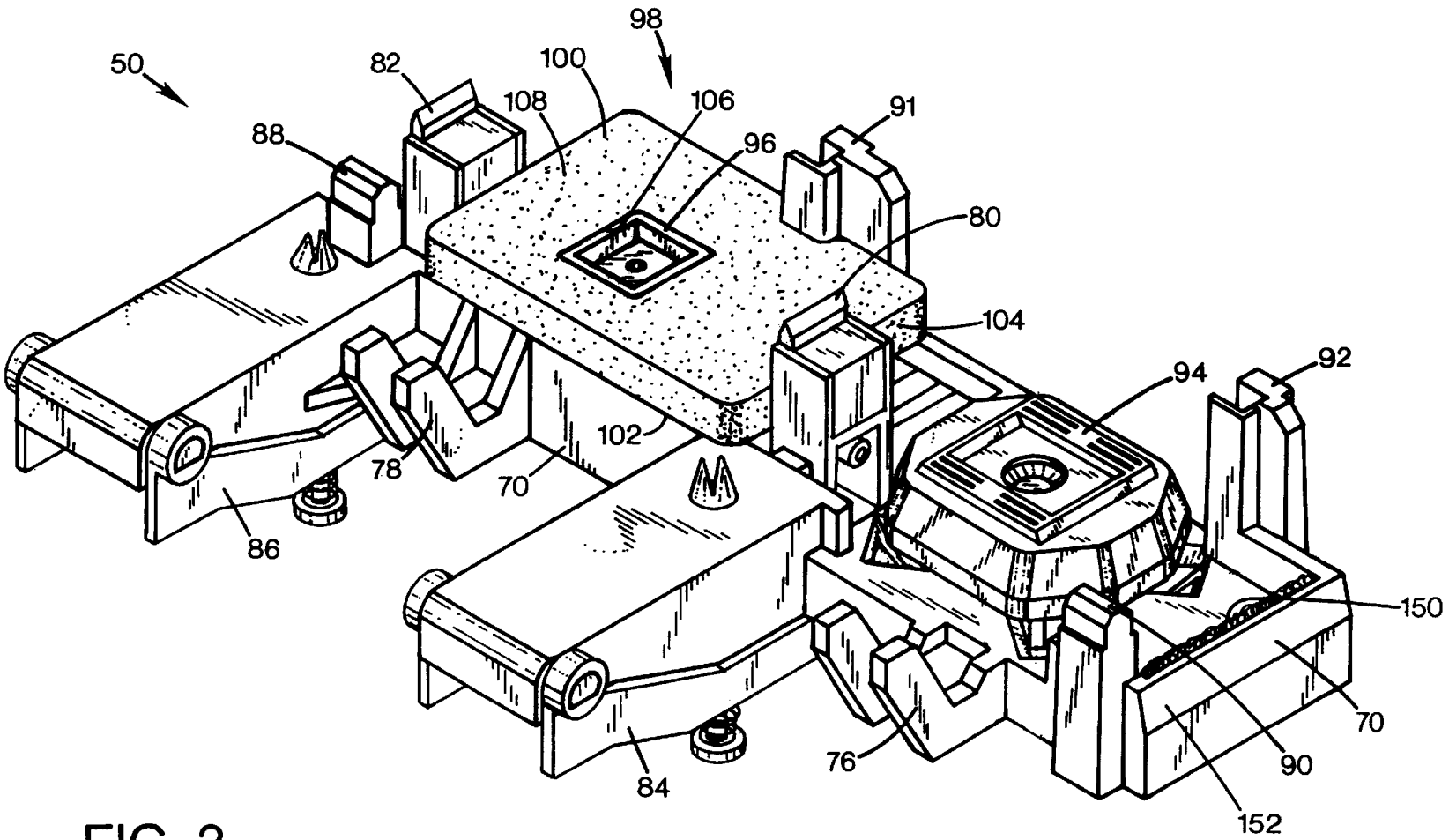
FIG. 2 is a perspective view of the fiber tracking management system of FIG. 1.

FIGS. 1 and 2 show one embodiment of the printhead service station 50 constructed in accordance with the present invention for servicing the black inkjet cartridge 60 and the color inkjet cartridge 62. The service station 50 includes a platform member or sled 70 that supports various servicing implements. During printing the sled 70 is at a rest position, lowered away from the path of printhead travel. To initiate servicing, a service station motor 72 moves the sled 70, preferably via a conventional rack and pinion gear mechanism 74, toward the printheads 64 and 66, which have been moved by carriage 52 to the servicing region 51. The sled 70 is coupled to the rack and pinion gear mechanism 74 by a base unit 75, shown schematically in FIG. 1, for instance, using two sets of mounting arms 76 and 78 (FIG. 2). The gear mechanism 74 and base unit 75 may be constructed in any conventional manner to move the servicing implements into engagement with the respective printheads, for instance, by using the mechanism shown in U.S. Pat. No. 5,155,497, assigned to the present assignee, Hewlett-Packard Company. Other mechanisms may also be used to move the sled 70 into servicing positions, such as by moving sled 70 laterally up a ramp (not shown) using the concepts expressed in U.S. Pat. No. 5,440,331, also assigned to the present assignee, Hewlett-Packard Company.

The service station 50 includes a black wiper 80 and a color wiper 82 for wiping printheads 64, 66, respectively, when pens 60, 62 are installed in carriage 52. The wipers 80, 82 are preferably of a resilient, non-abrasive, elastomeric material, such as nitrile rubber, or more preferably ethylene polypropylene diene monomer (EPDM), or other comparable materials known in the art. The sled 70 has two spring-biased wiper support arms 84, 86 which extend forwardly from the main body of the sled to receive pivoting wiper support members that hold the wipers 80 and 82. A preferred wiper support structure for securing wipers 80, 82 to the sled 70 is commercially available in the DeskJet® 660C model color inkjet printer, sold by the Hewlett-Packard Company of Palo Alto, Calif., and as described in U.S. Pat. No. 5,745,133, also assigned to the Hewlett-Packard Company. To assist in aligning the servicing components with the cartridges 60, 62, the sled 70 has two alignment members 88 and 90 located toward the front of the printer 20, and two rear alignment members 91 and 92 located toward the rear of sled 70.

The service station 50 has a black cap 94 for sealing printhead 64 of the black pen 60, and a color cap 96 for sealing printhead 66 of the color pen 62, with capping occurring during periods of printing inactivity. The color cap 96 may be of a conventional design, and both the black and color caps 94, 96 may be constructed of an elastomeric material, such as that described above for the wipers 80, 82. The illustrated black cap 94 has a construction which may be used for sealing a black printhead, or an interchangeable imaging printhead which typically is a tri-colored cartridge carrying black, cyan and magenta inks. The color inks in an imaging printhead typically have dye-loads which are reduced in concentration from that of the full color pen 62 to facilitate printing photographic-like images. Such an imaging system has been sold in the DeskJet® 693C model color inkjet printer, sold by the Hewlett-Packard Company, with the illustrated black cap 94 being described at length in U.S. Pat. No. 5,867,184, which is assigned to the Hewlett-Packard Company.

Figure 4:
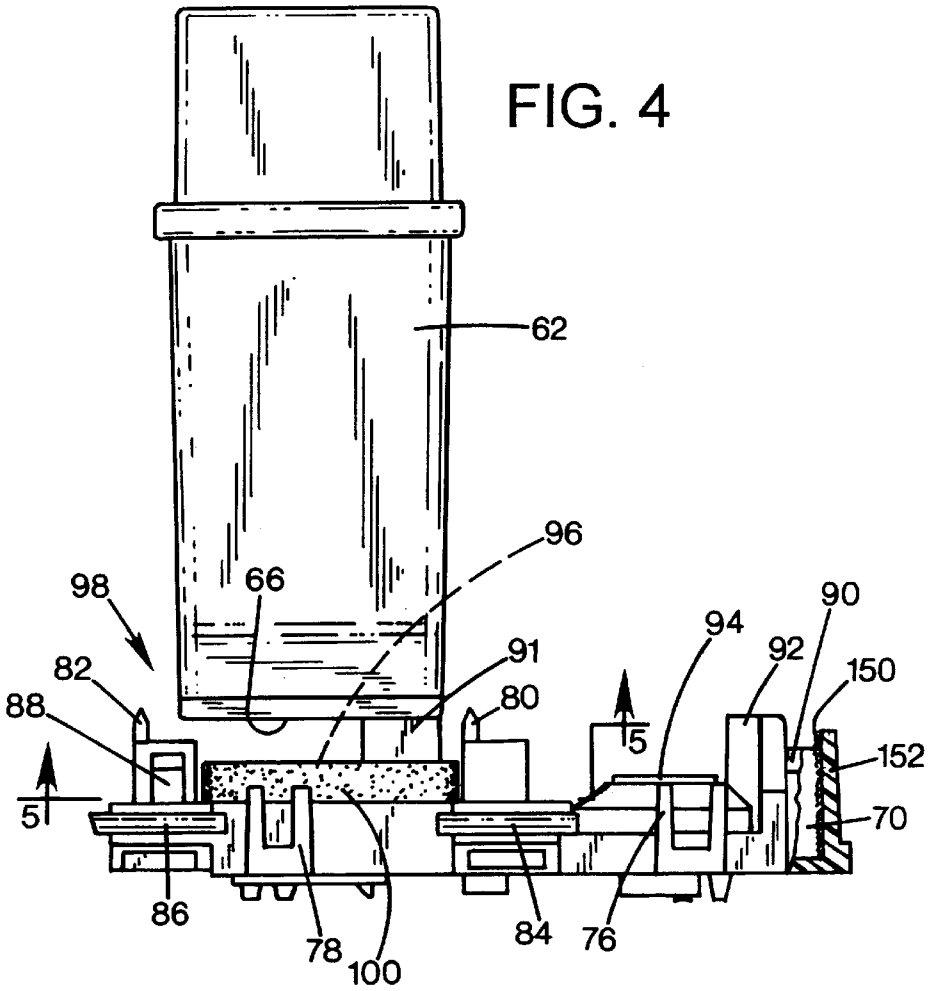
FIG. 4 is a front elevational view of the fiber tracking management system of FIG. 3.
Figure 3:
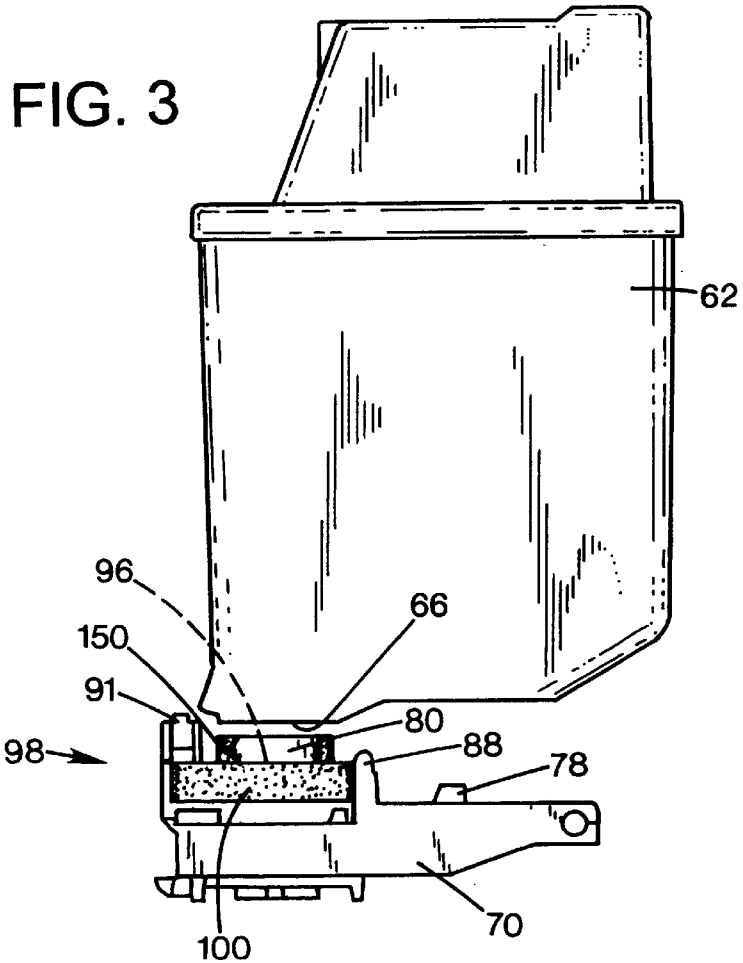
FIG. 3 is a side elevational view of the fiber tracking management system of FIG. 1, shown just prior to capping the printhead with the carriage, color wiper and color wiper support arm omitted for clarity.

Referring to FIGS. 2–4, the service station 50 includes a fiber tracking management system 98 that uses a fiber-crushing pad member 100, constructed in accordance with the present invention for minimizing fiber tracking print quality defects in printer 20. The fiber crusher pad 100 has an under surface 102 which is preferably bonded to the sled using an adhesive or other attachment means known to those skilled in the art. The pad has an outer periphery 104 with a contour designed to be received on the sled 70. The pad 100 also defines a generally rectangular or square slot 106 therethrough which is sized to surround the color cap 94. The fiber crusher pad 100 has an upper surface 108 which is used to manage fibers clinging to the printhead 66, along with the wipers 80, 82, as described further below.

Figure 5:
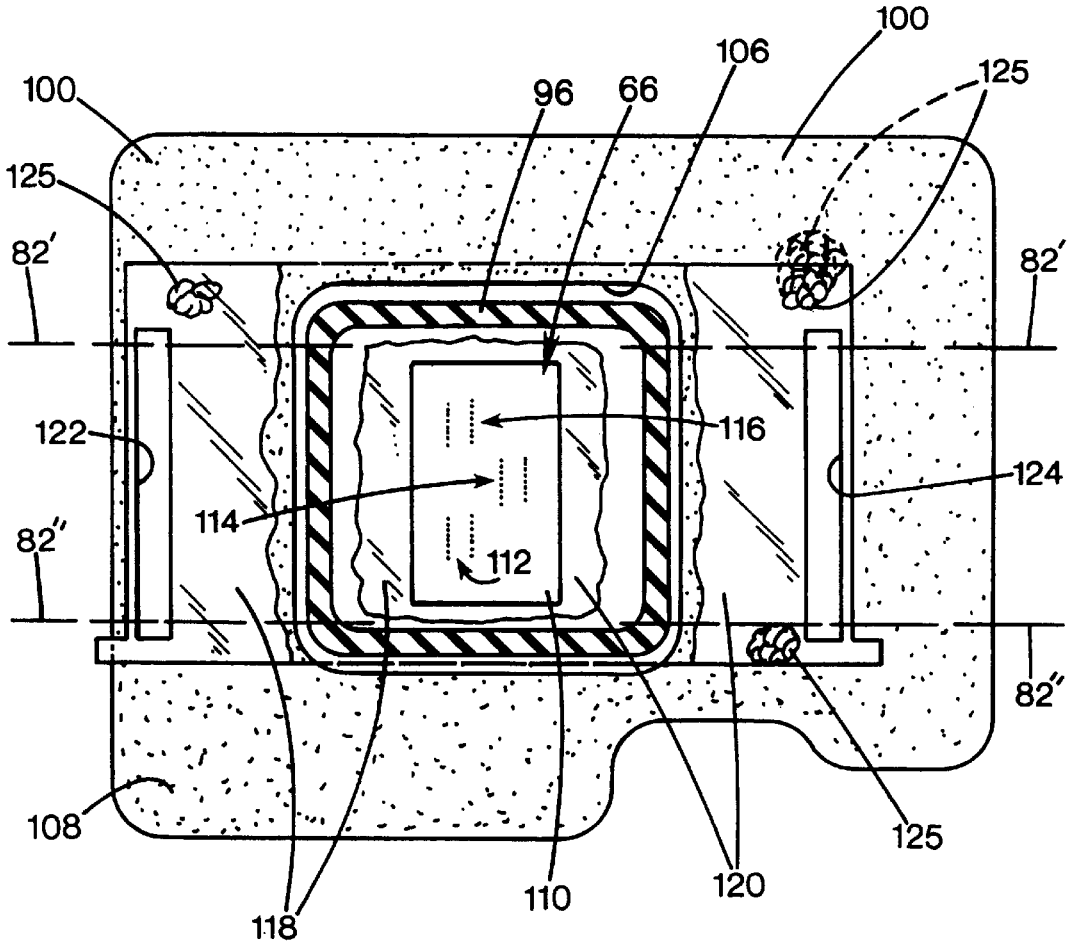
FIG. 5 is a sectional view taken along lines 5—5 of FIG. 4.

FIG. 5 illustrates the operation of the fiber crushing pad 100, in conjunction with the color wiper 82 to manage any fibers clinging to the color printhead 66. Here we see the printhead 66 includes an orifice plate 110, which has three groups of color inkjet nozzles 112, 114, and 116. The printhead 66 has non-printing regions surrounding the face plate 110 including two cheek regions 118 and 120. Here the outer periphery of the check regions 118 and 120 each define one of two wiper scraper cavities 122 and 124, respectively, which assist in cleaning the wiper 82 following printhead cleaning, and serve to collect ink residue and other debris. The wiping swath of the color wiper 82 is illustrated in FIG. 5 as the region line between the two dashed lines 82' and 82". The wiper 82 serves to remove any fibers, along with ink residue and other debris, within this region. However, this wiping swath between dashed lines and 82' and 82" fails to remove fibers 125 clinging to other regions of the printhead, as shown in FIG. 5. These non-wiped fibers 125 if not managed may contribute to the print quality defect known as fiber tracking.

The fiber crusher pad 100 acts to reduce fiber tracks in two different ways. First, the fiber crusher pad 100 serves to crush these fibers 125 against the printhead cheeks 118, 120, with any ink residue in these cheek regions serving to adhere the fibers in a flat position to cheeks 118, 120, rather than allowing them to dangle downwardly, and trail across freshly printed ink creating fiber tracks. Fibers which collect along the bottom surface of the pen 62 are continuously compressed against the surface of the printhead 66 during capping. By crushing or smashing fibers 125 into a horizontal position during the capping sequence, the fibers no longer hang down into the printzone 25, so they are prevented from dragging across freshly printed ink creating fiber tracks. If the unfortunate sequence occurs where some fibers do indeed create fiber tracks, it is believed that during the next capping sequence that these renegade fibers will be managed using the crusher pad 100, to recover high print quality because a fiber wet with ink is more likely to stick to the bottom surface of the pen than a dry fiber. In this way, the fiber management system 98 has the desirable property of recovering from fiber tracks. The second way the pad 100 manages fibers is through the absorption of excess ink on the printhead 66, particularly in the area of the scraper cavities 122 and 124. Controlling wet ink buildup on printhead 66 prevents new fibers from sticking to the cheek regions 118, 120, so it is less likely that the pen will collect fibers in the first place. This absorption property also extracts and collects ink residue which has accumulated on and around the scraper cavities 122, 124. Excess ink around scraper cavities 122, 124 is transferred to the pad 100 during capping. For the illustrated inks and pens, it has been found that printhead 66 collects such small amounts of excess ink under normal use conditions, that even the most absorbent materials have difficulty in having sufficient capillary draw to absorb these minute quantities of excess ink. Preferably, the fiber crusher pad is constructed from a semi-closed cell, hydrophilic, highly compressible, polyurethane foam.

In the illustrated embodiment, the pad upper surface 108 extends about 0.5 mm (millimeters) above the sealing lip of the color cap 96, so upon sealing the printhead 62, the pad 100 undergoes a compression of 1.0 mm±0.5 mm during a typical capping scenario, taking into consideration typical and the component dimension variations. Higher compressions in initial testing were found to be less effective for reducing fiber tracking frequency. The crusher pad 100 is preferably designed to cover as much surface area of the bottom of the printhead 66 as possible, without interfering with normal pen operations such as capping and wiping. Given these preferred constraints, the crusher pad 100 cannot contact the orifice pad 110. As mentioned above with respect to FIG. 5, fortunately wiper 82 moves any fibers on the orifice plate 110 to another region, while the cap 96 also serves to smash any fibers against the cheek regions 118, 120, so that combination, both the wiper 82 and the cap 96 are quite effective in preventing any fibers clinging to regions not contacted by pad 100 from extending down into the printzone 25.

Figure 6:
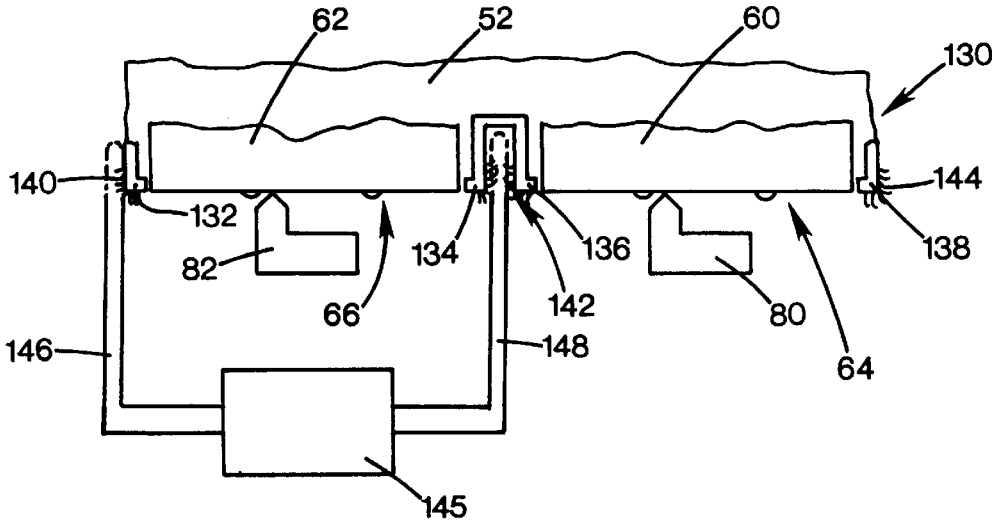
FIG. 6 a schematic front elevational view of one form of another embodiment of a fiber tracking management system of the present invention, which is preferably used in conjunction with the fiber tracking management system of the FIGS. 1–5.
Figure 7:
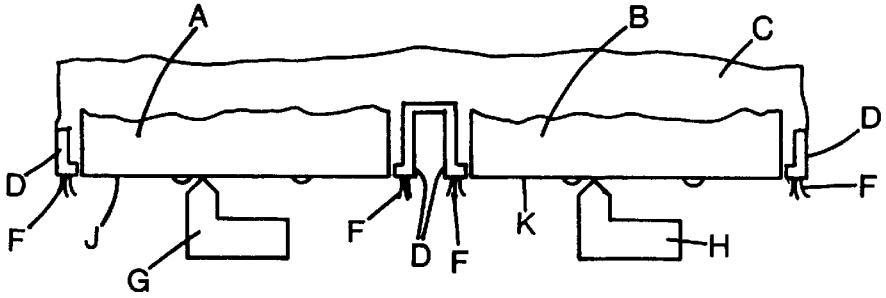
FIG. 7 PRIOR ART
FIG. 7 is a front elevational view of a prior art wiping system.

FIG. 6 illustrates a second embodiment of a fiber tracking management system, comprising a long datum wiping system 130, constructed in accordance with present invention, which may be used alone, or more preferably in conjunction with the fiber crusher pad 100. Here we see the pens 60 and 62 mounted in carriage 52, with the color pen 62 aligned against a pair of color pen datums 132, 134, and with the black pen 60 aligned against a pair of black pen datums 136, 138. Recall the discussion in the Background Section concerning FIG. 7, where the earlier wiping scheme allowed the black and color wipers to only wipe printhead faces J and K, and supposedly stop before reaching the pen carriage datums D. In reality, the stopping accuracy of the wiping system was such that for many wipe movements the wiper actually stopped on the datum surface, rather than between the pen and the datum, which left a line of ink on the datum. In particular, the color inks had a low surface tension so they moved through capillary action to wick ink all over the datum surfaces. In the new long datum wiping scheme 130, the wipers 80 and 82 take longer wiping strokes than the earlier wiping system of FIG. 7, moving beyond the carriage datums 132–138. This long datum wiping scheme 130 moves fibers from the printheads 62, 64 to the outboard side of the carriage datums, as shown for fibers 140 clinging to the side of datum 132, fibers 142 clinging between datums 134 and 136, while fibers 144 cling to the side of datum 138. As can be seen from a comparison of FIGS. 6 and 7, using the long datum wiping scheme 130, advantageously the fibers no longer hang below the carriage datums. However, over time the accumulation of fibers on the outboard sides of the datums must be handled. Advantageously, it was found that the feature already in use in the DeskJet 600 series color inkjet printers, sold by the Hewlett-Packard Company, efficiently removed the fiber buildup at two of the desired locations.

With reference to FIGS. 1 and 6, to assist in actuating the media pick and feed operations, printer 20 includes a clutch mechanism 145, which is activated through contact with carriage 52. The clutch mechanism 145 is activated to pick a sheet of fresh media from the supply tray 28. Note that FIG. 6 is serving the dual purpose of illustrating the long datum wiping scheme 130 with wipers 80, 82 in place, which are located to the right of the printzone 25 in FIG. 1, while FIG. 6 is also being used to illustrate the fiber cleaning operation of actuator 145, which is located to the left of the printzone 25. That is, when the wipers 80, 82 are contacting the printheads within the servicing region 51, the actuator 145 would be absent from the view, while during the fiber cleaning operation of actuator 145 past the left of the printzone 25, the wipers would be absent from the view.

The clutch mechanism 145 includes a clutch actuator 146, which is contacted by an outboard portion of carriage 52, adjacent the leftmost datum 132, as shown in FIG. 6. Activation of the actuator arm 146 by contact with carriage 52 causes the clutch mechanism 145 to move a second clutch arm 148 between the datums 134 and 136 of carriage 52. The clutch actuator 146 removes fibers 140, which were clinging to the outboard side of datum 132. In a similar manner, the second clutch arm 148 moves into the region between datums 134 and 136, and scrubs or plucks the fibers 142 that have collected in this region. Thus, upon beginning to print each new sheet of media, such as paper 34, the fibers 140 and 142 are swept away from the carriage datums. Thus, even if a reticent fiber 140 or 142 were to hang down into the printzone and create fiber tracks on a sheet, the self restoring nature of the fiber management system 98 removes these fibers, allowing re-printing of the sheet with the fiber tracking problem having been eliminated. It is apparent to those skilled in the art that, while the illustrated printer 20 makes use of the clutch actuator mechanism 145 to clear the fibers 140 and 142 from the datums 132–136, other mechanisms may be provided within an inkjet printing mechanism to clear these fibers from the outboard surfaces of the carriage alignment datums or other carriage structures upon which fibers may cling.

Having removed the fibers 140 and 142 with the actuator mechanism 145, the remaining fibers 144 clinging to the outboard surface of datum 138 are advantageously managed through use of a fiber disrupter pad 150. As shown in FIGS. 2–4, the disrupter pad 150 is mounted to an interior surface of wall 152, which forms a portion of the service station sled 70. The disrupter pad 150 may be any type of compressible material, but a preferable material is the loop portion of the hook and loop faster, such as a VELCRO® faster. The intertwined loops of this material serve to trap the fibers 144 and remove them from the outboard surface of datum 138, as well as act as a scrubbing surface to remove solid ink residue.

Thus, method of managing fibers to prevent fiber tracking in inkjet printing mechanism may be implemented using the concepts described above. Preferably, fibers clinging to an orifice plate region 110 of the printhead 62 are primarily removed through the wiping action of wiper 82. Following this wiping step, any fibers 125 remaining on the printhead in the cheek regions 118, 120 surrounding the orifice plate 110 are crushed against these cheek regions through contact with a fiber crushing member, such as pad 100. In a preferred embodiment, the fiber crushing member has a slot therethrough sized to surround the printhead cap 96, allowing the fiber crushing step to occur in conjunction was the printhead capping step. The fiber crushing action of pad 100 forms a preferred portion of the fiber management system 98, which may be enhanced through the use of a long datum wiping stroke, as described above with respect to FIG. 6, which also serves to remove trailing fibers from the black printhead 64. Use of the long datum wiping stroke scheme 130 pushes the fibers 140–144 toward the outboard edges of the datums, where they are removed in a fiber removal or plucking step by arms 146 and 148 of the clutch actuator 145, and by the fiber disrupter pad 150.

Conclusion

Thus, it is clear that the fiber management system described herein with respect to a preferred embodiment has a variety of advantages. One of the main advantages of the fiber management system 98 is the ability to prevent fiber tracking print quality defects in a customer's home or business, without requiring the printing mechanism to be returned for factory servicing if such defects should occur. As mentioned above, this fiber management system 98 advantageously provides a self-correcting remedy if fiber tracking should occur in an inkjet printer. Following a print job the printheads 64, 66 are typically first wiped and then capped, at which time the fiber crusher pad 100 and fiber disrupter pad 150 operate to collect and/or remove the fibers 125 and 144, respectively. At the initiation of the next print job, the carriage 52 travels to the left of the printzone 25 to operate the clutch mechanism 145, at which time the clutch actuator 146 and clutch arm 148 operate to remove the fibers 140, 142 from the carriage datums 132–136. Another significant advantage of the fiber management system 98 is that the fiber cleaning and control operations are performed in a manner which is transparent to the owner or operator. Thus, this fiber management occurs automatically in the inkjet printing mechanism without requiring the owner or operator to perform extensive cleaning operations.

It is apparent that the concepts of the fiber tracking management system described herein may be implemented in a variety of different ways, beyond those illustrated by the preferred embodiment. For example, in other service station arrangements, other positions may be found for supporting a fiber crusher pad and a fiber disrupter pad. Additionally, other mechanisms, such as absorbent members, mechanical linkages, brushes or pads may be used to remove fibers and ink residue from between carriage components, such as datums 134 and 136, and from other exterior surfaces of the carriage and printheads.

We claim:

1. A fiber tracking management system for controlling fibers clinging to an inkjet printhead installed in a carriage which traverses over a printzone to print an image on a print media with ink ejected from the printhead in an inkjet printing mechanism with the inkjet printhead having an orifice plate from which the ink is ejected and a cheek region adjacent to the orifice plate, the fiber tracking management system comprising:

a sled which moves between a rest position and a capping position a printhead cap supported by the sled to seal the orifice plate when the sled is in the capping position; and a fiber crushing member comprising a pad of compressible material supported by the sled to contact the printhead when the sled is in the servicing position and crush fibers dangling from the printhead against the printhead, wherein the fiber crushing member defines a slot therethrough, with the cap being located in the slot and extending a first distance from the sled when in the rest position and the fiber crushing pad extending a second distance from the sled, with the second distance being greater than the first distance, and wherein the fiber crushing member crushes said dangling fibers against the cheek region.

2. A fiber tracking management system according to claim 1 wherein the fiber crushing member comprises a pad of a compressible material.

3. A fiber tracking management system according to claim 2 wherein the fiber crushing pad of an absorbent compressible material.

4. A fiber tracking management system according to claim 3 wherein the fiber crushing pad of an absorbent compressible foam material.

5. A fiber tracking management system according to claim 1 for controlling fibers clinging to said inkjet printhead which has an orifice plate from which the ink is ejected, and a cheek region adjacent the orifice plate, wherein:

the sled also moves to a second servicing position comprising a wiping position; and the system further includes a wiper supported by the sled where, through relative motion of the wiper and the printhead, the wiper wipes across the printhead orifice plate and across a first portion of the cheek region to remove ink residue and fibers therefrom when the sled is in the wiping position.

6. A fiber tracking management system according to claim 5, with said cheek region of the printhead defining a wiper scraper cavity, wherein:

the wiper deposits said ink residue in the wiper scraper cavity during said relative motion; and the fiber crushing member is of an absorbent material which extracts the deposited ink residue from the wiper scraper cavity when the sled is in the servicing position.

7. A fiber tracking management system according to claim 5 for a carriage having a feature located adjacent the printhead and extending over the printzone, with said feature having an exterior surface, wherein:

the wiper deposits the fibers removed from the printhead along the exterior surface of the carriage feature;

the printzone has a proximate end and a distal end, with the sled being located beyond the proximate end of the printzone; and the system further includes a fiber remover located past said distal end of the printzone to remove fibers deposited along the exterior surface of the carriage feature.

8. A fiber tracking management system according to claim 5 for a carriage having a feature located adjacent the printhead and extending over the printzone, with said feature having an exterior surface, wherein:

the wiper deposits the fibers removed from the printhead along the exterior surface of the carriage feature; and the system further includes a fiber remover supported by the sled to remove fibers deposited along the exterior surface of the carriage feature.

9. A fiber tracking management system according to claim 8 wherein the fiber remover is supported by the sled to remove fibers from the carriage feature exterior surface when the sled is in said servicing position.

10. A fiber tracking management system according to claim 9 wherein the fiber remover comprises a pad of a compressible material.

11. A fiber tracking management system according to claim 9 wherein the fiber remover comprises a loop faster portion of a hook and loop fabric faster.

12. A fiber tracking management system according to claim 5 wherein said relative motion comprises moving the printhead across the wiper.

13. A fiber tracking management system according to claim 5 wherein:

the servicing position comprises a capping position;

the system further includes a printhead cap supported by the sled to seal the orifice plate when the sled is in the capping position; and the fiber crushing member defines a slot therethrough, with the cap being located in the slot, and with the fiber crushing member crushing said dangling fibers against the cheek region.

14. A fiber tracking management system for controlling fibers clinging to an inkjet printhead installed in a carriage which traverses over a printzone to print an image on a print media with ink ejected from the printhead in an inkjet printing mechanism, with the inkjet printhead having an orifice plate from which the ink is ejected and a cheek region adjacent the orifice plate, with the printing mechanism having a media drive apparatus for advancing the media through the printzone, the fiber tracking management system comprising:

a sled which moves between a rest position and a wiping position;

a carriage having a feature located adjacent the printhead and extend over the printzone, with said feature having an exterior surface;

a wiper supported by the sled where, through relative motion of the wiper and the printhead, the wiper wipes across the printhead orifice plate and across a first portion of the cheek region to remove ink residue and fibers therefrom when the sled is in the wiping position, and deposits at least some of the fibers removed from the printhead along the exterior surface of the carriage feature; and a fiber remover which removes fibers deposited along the exterior surface of the carriage feature, wherein the fiber remover comprises a clutch actuator member for actuating the media drive apparatus with the clutch actuator member being activated through contact with said carriage.

15. A fiber tracking management system according to claim 14 wherein the fiber remover comprises a pad supported by the sled to remove fibers deposited along the exterior surface of the carriage feature, with said pad being of a loop faster portion of a hook and loop fabric faster.

16. A fiber tracking management system according to claim 14 wherein:

the printzone has a proximate end and a distal end, with the sled being located beyond the proximate end of the printzone; and the fiber remover is located beyond said distal end of the printzone to remove fibers deposited along the exterior surface of the carriage feature.

17. A fiber tracking management system according to claim 14 wherein:

the sled also moves to a servicing position; and the system further includes a fiber crushing member supported by the sled to contact the printhead when the sled is in the servicing position and crush fibers dangling from the printhead against the printhead.

18. A fiber tracking management system according to claim 17 wherein:

the servicing position comprises a capping position;

the system further includes a printhead cap supported by the sled to seal the orifice plate when the sled is in the capping position; and the fiber crushing member defines a slot therethrough, with the cap being located in the slot, and with the fiber crushing member crushing said dangling fibers against the cheek region.

19. A fiber tracking management system according to claim 17 wherein said carriage feature comprises a datum member used to align the printhead to the carriage.

20. An inkjet printing mechanism, comprising:

an inkjet printhead having an orifice plate from which the ink is ejected, and a cheek region adjacent the orifice plate;

a carriage supporting the printhead, with the carriage traversing over a printzone to print an image on a print media with ink ejected from the printhead, and with the carriage having a feature located adjacent the printhead and extending over the printzone, with said feature having an exterior surface;

a sled which moves between a rest position and a servicing position;

a fiber tracking management system for controlling fibers clinging to with ink ejected from the printhead in an inkjet printing mechanism, with the fiber tracking management system including a fiber crushing member supported by the sled to contact the printhead when the sled is in the servicing position and crush fibers dangling from the printhead against the printhead, wherein the printzone has a proximate end and a distal end with the sled being located beyond the proximate end of the printzone, and the fiber remover is located beyond said distal end of the printzone to remove fibers deposited along the exterior surface of the carriage feature; and a media drive apparatus for advancing the media through the printzone, wherein the fiber remover comprises a clutch actuator member for actuating the media drive apparatus, with the clutch actuator member being activated through contact with said carriage.

21. An inkjet printing mechanism according to claim 20, wherein:

the servicing position comprises a capping position;

the inkjet printing mechanism further includes a printhead cap supported by the sled to seal the orifice plate when the sled is in the capping position; and the fiber crushing member defines a slot therethrough, with the cap being located in the slot, and with the fiber crushing member crushing said dangling fibers against the cheek region.

22. An inkjet printing mechanism according to claim 20, wherein the fiber crushing member comprises a pad of an absorbent compressible foam material.

23. An inkjet printing mechanism according to claim 20, wherein the fiber the sled also moves to a second servicing position comprising a wiping position; and the inkjet printing mechanism further includes a wiper supported by the sled where, through relative motion of the wiper and the printhead, the wiper wipes across the printhead orifice plate and across a first portion of the cheek region to remove ink residue and fibers therefrom when the sled is in the wiping position.

24. An inkjet printing mechanism according to claim 23 wherein said relative motion of the wiper and the printhead comprises moving the printhead across the wiper.

25. An inkjet printing mechanism according to claim 23 wherein:

said cheek region of the printhead defines a wiper scraper cavity;

the wiper deposits said ink residue in the wiper scraper cavity during said relative motion; and the fiber crushing member is of an absorbent material which extracts the deposited ink residue from the wiper scraper cavity when the sled is in said servicing position.

26. An inkjet printing mechanism according to claim 23 wherein:

the carriage has a feature located adjacent the printhead and extending over the printzone, with said feature having an exterior surface;

the wiper deposits the fibers removed from the printhead along the exterior surface of the carriage feature;

the printzone has a proximate end and a distal end, with the sled being located beyond the proximate end of the printzone; and the system further includes a fiber remover located past said distal end of the printzone to remove fibers deposited along the exterior surface of the carriage feature.

27. An inkjet printing mechanism according to claim 23 wherein:

the carriage has a feature located adjacent the printhead and extending over the printzone, with said feature having an exterior surface;

the wiper deposits the fibers removed from the printhead along the exterior surface of the carriage feature; and the system further includes a fiber remover supported by the sled to remove fibers deposited along the exterior surface of the carriage feature.

28. An inkjet printing mechanism according to claim 27 wherein the fiber remover is supported by the sled to remove fibers from the carriage feature exterior surface when the sled is in said servicing position.

29. An inkjet printing mechanism according to claim 27 wherein the fiber remover comprises a pad of a loop faster portion of a hook and loop fabric faster.

30. An inkjet printing mechanism, comprising:

an inkjet printhead having an orifice plate from which the ink is ejected, and a cheek region adjacent the orifice plate;

a carriage supporting the printhead, with the carriage traversing over a printzone to print an image on a print media with ink ejected from the printhead, and with the carriage having a feature located adjacent the printhead and extending over the printzone, with said feature having an exterior surface;

a sled which moves between a rest position, a servicing position, and to a wiping position;

a wiper supported by the sled where, through relative motion of the wiper and the printhead, the wiper wipes across the printhead orifice plate and across a first portion of the cheek region to remove ink residue and fibers therefrom when the sled is in the wiping position, and deposits the fibers removed from the printhead along the exterior surface of the carriage feature;

a fiber tracking management system for controlling fibers clinging to with ink ejected from the printhead in an inkjet printing mechanism, with the fiber tracking management system including a fiber remover which removes fibers deposited along the exterior surface of the carriage feature; and a media drive apparatus for advancing the media through the printzone, wherein the fiber remover comprises a clutch actuator member for actuating the media drive apparatus, with the clutch actuator member being activated through contact with said carriage.

31. An inkjet printing mechanism according to claim 30 wherein the fiber remover comprises a pad supported by the sled to remove fibers deposited along the exterior surface of the carriage feature, with said pad being of a loop faster portion of a hook and loop fabric faster.

32. An inkjet printing mechanism according to claim 30 wherein:

the printzone has a proximate end and a distal end, with the sled being located beyond the proximate end of the printzone; and the fiber remover is located beyond said distal end of the printzone to remove fibers deposited along the exterior surface of the carriage feature.

33. A method of controlling fibers clinging to an inkjet printhead installed in a carriage which traverses over a printzone to print an image on a print media with ink ejected from the printhead in an inkjet printing mechanism, comprising the steps of:

moving the printhead into a servicing region of the inkjet printing mechanism;

crushing fibers dangling from the printhead against the printhead with a fiber crushing member;

wiping fibers dangling from the printhead;

depositing the wiped fibers onto an exterior surface of a carriage feature located adjacent the printhead and extending over the printzone; and removing the fibers from the exterior surface of a carriage feature when the printhead is capped, wherein the removing step includes scrubbing the fibers off of the exterior surface of the carriage feature when media is picked for advancement toward the printzone.

* * * * *

UNITED STATES PATENT AND TRADEMARK OFFICE

CERTIFICATE OF CORRECTION

PATENT NO. : 6,435,646 B2
DATED : August 20, 2002
INVENTOR(S) : Martin et al.

It is certified that error appears in the above-identified patent and that said Letters Patent is hereby corrected as shown below:

Column 13,
Line 64, "the fiber" should be deleted.

Signed and Sealed this

Eighteenth Day of February, 2003

JAMES E. ROGAN
*Director of the United States Patent and Trademark Office*